US005913349A

United States Patent [19]

Festus

[11] Patent Number: 5,913,349

[45] Date of Patent: Jun. 22, 1999

[54] CREDIT CARD WALLET

[76] Inventor: Lisa A. Festus, 168-22 127th Ave., #7G, Jamaica, N.Y. 11434

[21] Appl. No.: 09/044,342

[22] Filed: Mar. 19, 1998

[51] Int. Cl.[6] ..... A45C 1/00; A45C 1/06

[52] U.S. Cl. ..... 150/143; 150/145; 150/147; 150/149

[58] Field of Search ..... 150/117, 131, 150/132, 139, 143, 145, 147

[56] References Cited

U.S. PATENT DOCUMENTS

| | | | |
|---|---|---|---|
| 814,205 | 3/1906 | Hawes | 150/143 X |
| 1,088,784 | 3/1914 | Livingston | 150/117 |
| 1,579,017 | 3/1926 | Marymont | 150/132 X |
| 1,937,384 | 11/1933 | Hess | 150/143 X |
| 2,358,983 | 9/1944 | Lyndes et al. | 150/143 |
| 2,652,089 | 9/1953 | Cramer | 150/117 |
| 2,746,504 | 5/1956 | Powell | 150/132 X |
| 2,784,757 | 3/1957 | Bosca et al. | 150/143 X |
| 3,304,978 | 2/1967 | Guterman et al. | 150/117 |
| 3,483,909 | 12/1969 | Osher et al. | 150/145 X |
| 3,744,541 | 7/1973 | Brauhut | 150/143 |
| 4,126,168 | 11/1978 | Ganz et al. | 150/143 X |
| 4,705,086 | 11/1987 | O'Neill | 150/145 X |
| 4,951,811 | 8/1990 | Lines | 150/117 X |
| 5,052,328 | 10/1991 | Eppenbach | 150/134 X |

FOREIGN PATENT DOCUMENTS

| | | | |
|---|---|---|---|
| 570953 | 5/1924 | France | 150/131 |
| 9320729 | 10/1993 | WIPO | 150/147 |

*Primary Examiner*—Sue A. Weaver

[57] ABSTRACT

A wallet for credit cards is provided including a strip having at least one crease formed therein for allowing the folding of the same. Also included is a credit card storage sleeve mounted on the strip for containing a plurality of credit cards. At least one message is situated on the wallet and exposed only when the strip is unfolded. The message functions for warning a user about the use of credit cards.

6 Claims, 3 Drawing Sheets

FIG 7
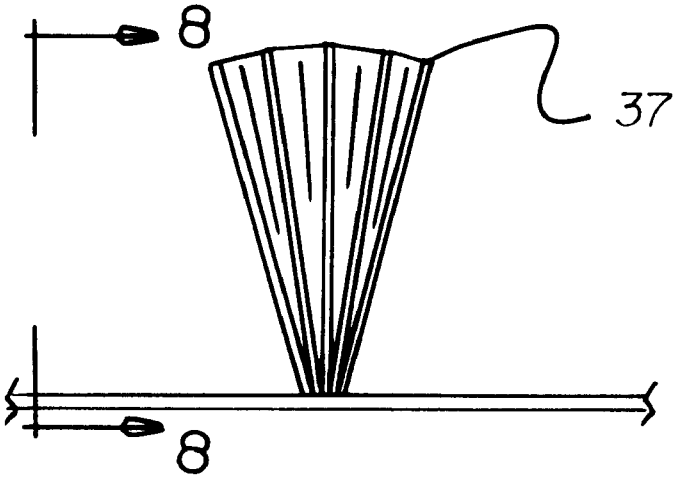
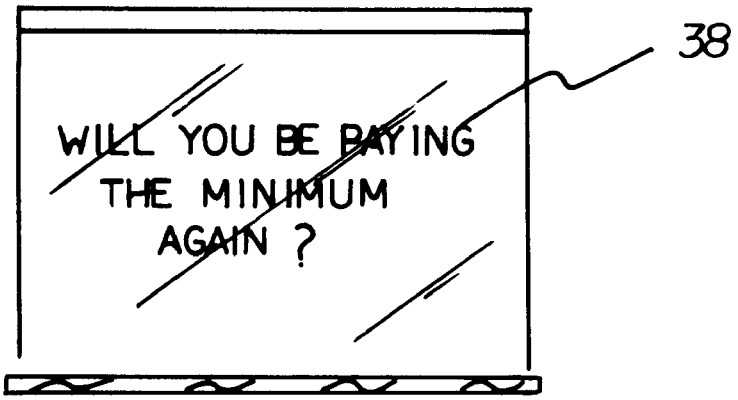
FIG 8

CREDIT CARD WALLET

BACKGROUND OF THE INVENTION

1. Field of the Invention

The present invention relates to wallets and more particularly pertains to a new credit card wallet for abating the haphazard use of credit cards.

2. Description of the Prior Art

The use of wallets is known in the prior art. More specifically, wallets heretofore devised and utilized are known to consist basically of familiar, expected and obvious structural configurations, notwithstanding the myriad of designs encompassed by the crowded prior art which have been developed for the fulfillment of countless objectives and requirements.

Known prior art wallets include U.S. Pat. No. 4,796,750; U.S. Pat. No. 5,184,657; U.S. Pat. No. 5,257,656; U.S. Pat. No. 4,671,332; Des. U.S. Pat. No. 358,478; and U.S. Pat. No. 4,209,048.

In these respects, the credit card wallet according to the present invention substantially departs from the conventional concepts and designs of the prior art, and in so doing provides an apparatus primarily developed for the purpose of abating the haphazard use of credit cards.

SUMMARY OF THE INVENTION

In view of the foregoing disadvantages inherent in the known types of wallets now present in the prior art, the present invention provides a new credit card wallet construction wherein the same can be utilized for abating the haphazard use of credit cards.

The general purpose of the present invention, which will be described subsequently in greater detail, is to provide a new credit card wallet apparatus and method which has many of the advantages of the wallets mentioned heretofore and many novel features that result in a new credit card wallet which is not anticipated, rendered obvious, suggested, or even implied by any of the prior art wallets, either alone or in any combination thereof.

To attain this, the present invention generally comprises a rectangular strip having a plurality of laterally extending creases formed therein along a length thereof. Such creases define a plurality of equally sized sections each with a front face, a rear face, a top edge and a bottom edge. The sections include, from top to bottom, a first section, a second section, a third section, a fourth section, and a fifth section. As will soon become apparent, each section has a fastening means mounted thereon. It should be noted that in the following description, the bottom and top edges of adjacent section are considered the same. As shown in FIGS. 3–6, the first section has a pile fastener mounted on the front face thereof along the top edge thereof. The second section has a zipper mounted on the front face thereof along the top edge thereof. The rear face of the second section has a first message situated thereon. With continuing reference to FIGS. 3–6, the third section has snaps mounted on its front face along the top edge thereof. A pile fastener is mounted on the rear face along the top edge of the third section. The third section has a second message situated on the rear face thereof. The fourth section has buttons mounted on its front face along the top edge thereof. Mounted on the rear face of the fourth section and along the top edge thereof is a zipper. It should be noted that the fourth section has a third message situated on the rear face thereof. Finally, a fifth section has snaps and button slits mounted on its rear face along the top and bottom edges thereof, respectively. The rear face of the fifth section further has a fourth message situated thereon. Associated therewith is a fifth message positioned on the front face of the fifth section. As shown in FIG. 7, a plurality of sleeves are each coupled along a top edge of the fifth section and equipped with an open bottom edge for receiving a credit card therein.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new credit card wallet apparatus and method which has many of the advantages of the wallets mentioned heretofore and many novel features that result in a new credit card wallet which is not anticipated, rendered obvious, suggested, or even implied by any of the prior art wallets, either alone or in any combination thereof.

It is another object of the present invention to provide a new credit card wallet which may be easily and efficiently manufactured and marketed.

It is a further object of the present invention to provide a new credit card wallet which is of a durable and reliable construction.

An even further object of the present invention is to provide a new credit card wallet which is susceptible of a low cost of manufacture with regard to both materials and labor, and which accordingly is then susceptible of low prices of sale to the consuming public, thereby making such credit card wallet economically available to the buying public.

Still yet another object of the present invention is to provide a new credit card wallet which provides in the apparatuses and methods of the prior art some of the advantages thereof, while simultaneously overcoming some of the disadvantages normally associated therewith.

Still another object of the present invention is to provide a new credit card wallet for abating the haphazard use of credit cards.

Even still another object of the present invention is to provide a new credit card wallet that includes a strip having at least one crease formed therein for allowing the folding of the same. Also included is a credit card storage sleeve mounted on the strip for containing a plurality of credit cards. At least one message is situated on the wallet and exposed only when the strip is unfolded. The message functions for warning a user about the use of credit cards.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 7 is a side view of the sleeves of the present invention.

FIG. 8 is an illustration of the sixth indicia of the present invention situated on the sleeves of FIG. 7.

DESCRIPTION OF THE PREFERRED EMBODIMENT

Figure 1:
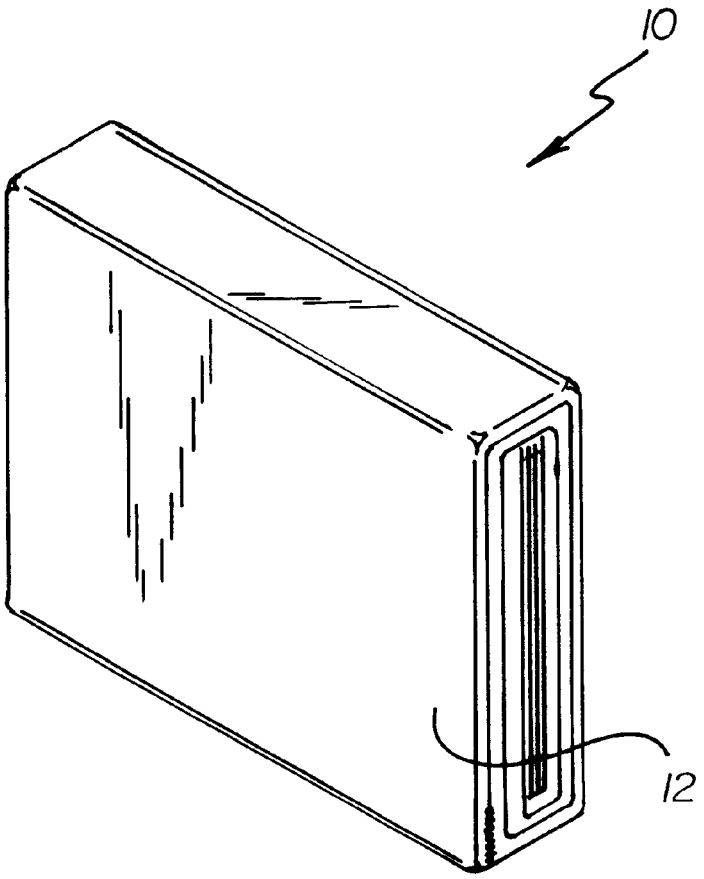
FIG. 1 is a perspective view of a new credit card wallet according to the present invention.
Figure 2:
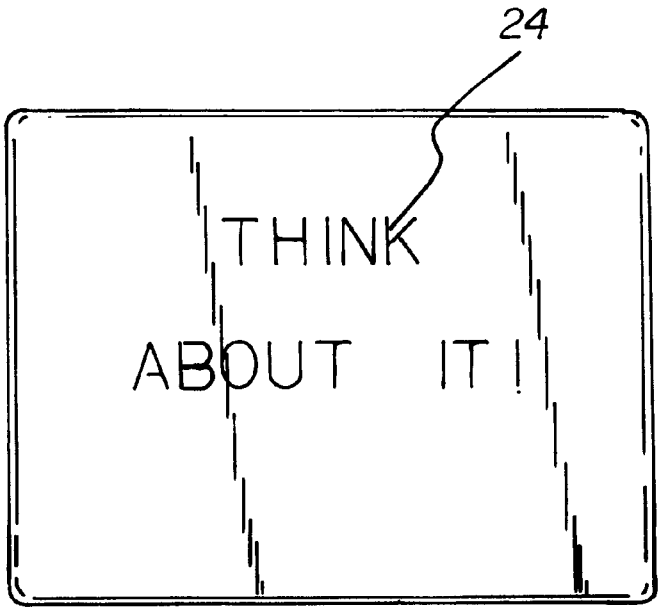
FIG. 2 is a front view of the present invention.
Figure 3:
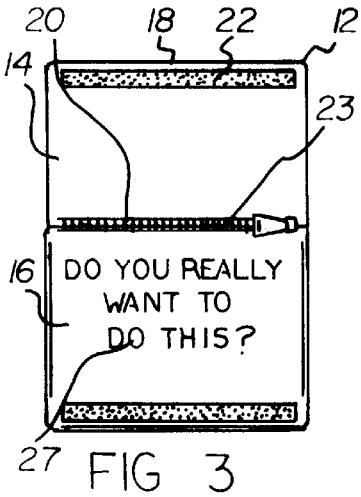
FIGS. 3–6 show the progressive unfolding of the present invention.
Figure 4:
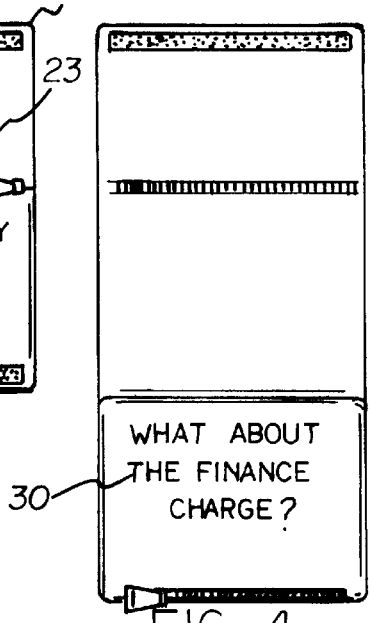
Figure 6:
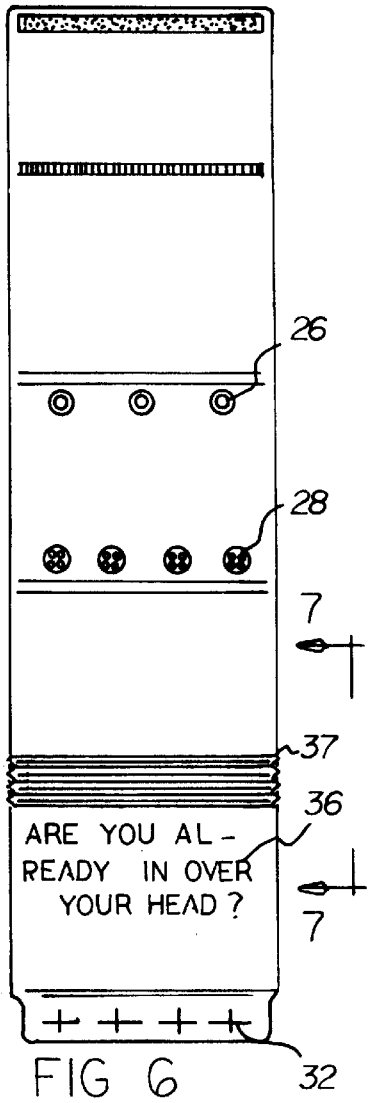

With reference now to the drawings, and in particular to FIGS. 1 through 8 thereof, a new credit card wallet embodying the principles and concepts of the present invention and generally designated by the reference numeral 10 will be described.

The present invention, designated as numeral 10, includes a rectangular strip 12 having a plurality of laterally extending creases formed therein along a length thereof. Such creases define a plurality of equally sized sections each with a front face 14, a rear face 16, a top edge 18 and a bottom edge 20. The sections include, from top to bottom, a first section, a second section, a third section, a fourth section, and a fifth section. As will soon become apparent, each section has a fastening means mounted thereon. It should be noted that in the following description, it is critical that the bottom and top edges of adjacent sections be considered the same.

As shown in FIGS. 3–6, the first section has a pile fastener 22 mounted on the front face thereof along the top edge thereof. The second section has a zipper 23 mounted on the front face thereof along the top edge thereof. The rear face of the second section has a first message 24 situated thereon. Note FIG. 2.

With continuing reference to FIGS. 3–6, the third section has snaps 26 mounted on its front face along the top edge thereof. A pile fastener is mounted on the rear face along the top edge of the third section. The third section has a second message 27 situated on the rear face thereof. Note FIG. 3.

The fourth section has buttons 28 mounted on its front face along the top edge thereof. Mounted on the rear face of the fourth section and along the top edge thereof is a zipper. It should be noted that the fourth section has a third message 30 situated on the rear face thereof. Note FIG. 4.

Figure 5:
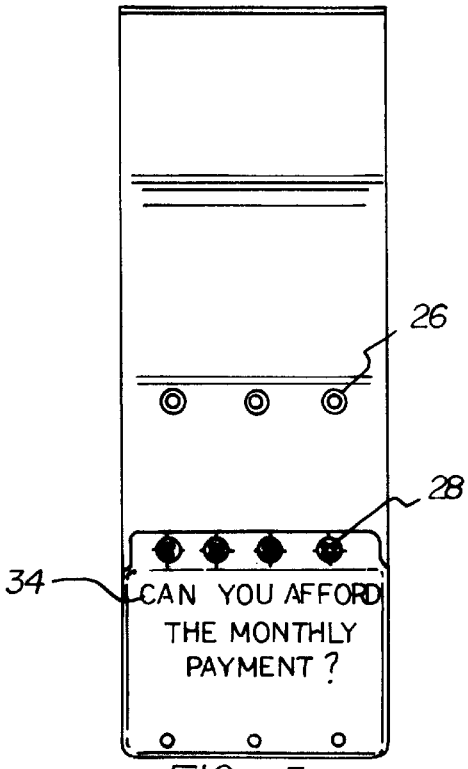

Finally, a fifth section has snaps and button slits 32 mounted on its rear face along the top and bottom edges thereof, respectively. The rear face of the fifth section further has a fourth message 34 situated thereon, as shown in FIG. 5. Associated therewith is a fifth message 36 positioned on the front face of the fifth section. Note FIG. 6. As shown in FIG. 7, a plurality of sleeves 37 are each coupled along a top edge of the fifth section and equipped with an open bottom edge for receiving a credit card therein. In the preferred embodiment, the sleeves have a sixth message 38 printed thereon, as shown in FIG. 8.

In use, the strip may be unfolded section by section, from top to bottom. Upon each section being unfolded, the corresponding fastening means must be uncoupled and further one of the messages is exposed warning a user about the use of credit cards.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A wallet for credit cards comprising, in combination:

a rectangular strip having a plurality of laterally extending creases formed therein along a length thereof for defining a plurality of equally sized sections each with a front face, a rear face, a top edge and a bottom edge, the sections including, from top to bottom, a first section, a second section, a third section, a fourth section, and a fifth section;

said first section having a pile fastener mounted on the front face thereof along the top edge thereof;

said second section having a zipper mounted on the front face thereof along the top edge thereof, wherein the rear face of the second section has a first message situated thereon;

said third section having snaps mounted on the front face thereof along the top edge thereof and a pile fastener mounted on the rear face along the top edge thereof, wherein the third section has a second message situated on the rear face thereof;

said fourth section having buttons mounted on the front face thereof along the top edge thereof and a zipper mounted the rear face along the top edge thereof, wherein the fourth section has a third message situated on the rear face thereof;

said fifth section having snaps and button slits mounted on the rear face thereof along the top and bottom edges thereof, respectively, the rear face of the fifth section having a fourth message situated thereon, the front face of the fifth section having a fifth message thereon, wherein a plurality of sleeves are each coupled along a top edge thereof to the top edge of the fifth section with an open bottom edge for receiving a credit card therein;

whereby the strip may be unfolded section by section, from top to bottom such that upon each section being unfolded one of the messages is exposed warning a user about the use of credit cards.

2. A wallet for credit cards comprising:

a strip having a plurality of creases formed therein for allowing the folding of the same, wherein a length of the strip lengthens upon each crease being unfolded;

credit card storage means mounted on the strip for containing at least one credit card; and a plurality of unique messages situated on the wallet and exposed each time the strip is unfolded, wherein each message warns a user about the use of the credit card;

wherein at least two creases are formed in the strip and fastening means are mounted along each of the creases and must be unfastened as the strip is being unfolded.

3. A wallet for credit cards as set forth in claim 2 wherein the fastening means are such that the fastening means includes a first fastening means which is unfastened prior to a second fastening means, wherein the second fastening means includes a zipper and the first fastening means includes a pile fastener.

4. A wallet for credit cards as set forth in claim 2 wherein the strip must be unfolded at least once subsequent the unfastening of each fastening means.

5. A wallet for credit cards as set forth in claim 2 wherein the fastening means must each be unfastened prior to access being afforded to the credit card storage means.

6. A wallet for credit cards as set forth in claim 2 wherein the credit card storage means includes a plurality of sleeves.

* * * * *